US008240724B2

(12) United States Patent
Boonmatun

(10) Patent No.: US 8,240,724 B2
(45) Date of Patent: Aug. 14, 2012

(54) ROBUST OVER-CENTER LATCH ASSEMBLY

(75) Inventor: Supan Boonmatun, Udornthani (TH)

(73) Assignee: Hitachi Global Storage Technologies, Netherlands B.V., Amsterdam (NL)

( * ) Notice: Subject to any disclaimer, the term of this patent is extended or adjusted under 35 U.S.C. 154(b) by 812 days.

(21) Appl. No.: 12/103,623

(22) Filed: Apr. 15, 2008

(65) Prior Publication Data

US 2009/0255089 A1 Oct. 15, 2009

(51) Int. Cl.
*E05C 5/00* (2006.01)
*E05C 19/14* (2006.01)

(52) U.S. Cl. ..... 292/247; 292/DIG. 49

(58) Field of Classification Search ..... 292/247, 292/DIG. 49
See application file for complete search history.

(56) References Cited

U.S. PATENT DOCUMENTS

| | | | | |
|---|---|---|---|---|
| 2,331,403 | A | 10/1943 | Leonard | |
| 2,635,910 | A * | 4/1953 | Cataldo | 292/247 |
| 2,653,842 | A | 9/1953 | Love | |
| 2,714,032 | A | 7/1955 | Summers | |
| 3,146,011 | A * | 8/1964 | Seevers | 292/247 |
| 4,307,906 | A * | 12/1981 | Schenk | 292/247 |
| 4,428,608 | A * | 1/1984 | Cooke et al. | 292/247 |
| 4,629,228 | A * | 12/1986 | Marko et al. | 292/165 |
| 4,917,421 | A | 4/1990 | Wightman et al. | |
| 5,862,570 | A * | 1/1999 | Lezuch et al. | 16/82 |
| 6,042,156 | A * | 3/2000 | Jackson | 292/26 |
| 6,109,670 | A * | 8/2000 | Tomaszewski et al. | 292/216 |
| 6,860,530 | B2 * | 3/2005 | Senn | 292/285 |
| 7,156,429 | B2 * | 1/2007 | Eriksson | 292/247 |
| 7,360,804 | B1 * | 4/2008 | Fidali et al. | 292/262 |
| 7,651,141 | B2 * | 1/2010 | Kraenzle | 292/341.17 |
| 7,938,461 | B2 * | 5/2011 | Ollinger | 292/338 |

FOREIGN PATENT DOCUMENTS

| | | |
|---|---|---|
| EP | 0232585 | 1/1991 |
| GB | 2276415 | 9/1994 |
| JP | 07-279520 | 10/1995 |
| JP | 2003-175952 | 6/2003 |
| WO | WO-01/58773 | 8/2001 |

OTHER PUBLICATIONS

PROTEX, "Adjustable Fasteners", *Protex Catalogue*, http://www.protex.com/pdffiles/Protex_Catalogue.pdf, (2005),4 pages.

* cited by examiner

*Primary Examiner* — Carlos Lugo

(57) ABSTRACT

An over-center latch assembly has a base for attaching the over-center latch assembly to a first part of a unit. The first part of the unit is moveable to a second part of the unit. A handle is rotatably coupled to the base by a hinge. A pivot is coupled to the handle such that the pivot traverses about the hinge. The pivot is configured to receive a hasp. A stop surface is coupled to the base whereby rotation of the handle about the hinge is limited by the stop surface. A hinge bearing is coupled to the hinge. The hinge bearing enables an increased quantity of latch/unlatch cycles of the over-center latch assembly before failure of the over-center latch assembly.

18 Claims, 5 Drawing Sheets

ROBUST OVER-CENTER LATCH ASSEMBLY

TECHNICAL FIELD

This invention relates generally to the field of latching devices and in particular to over-center latching devices typically used for temporarily securing parts together.

BACKGROUND

There exist many assemblies that are composed of parts that require temporary securing of primary parts to secondary parts. Temporarily securing parts to each other is commonly achieved by a device known as a latch. Some examples of latch applications seen in everyday life which temporarily secure one part to another are: an engine compartment hood on a commercial vehicle, such as a tractor-trailer and a JEEP; a tool box lid secured to its main compartment; compartment doors for heavy duty vehicles, such as contractor trucks, fire engines, and utility trucks; and service panel doors in commercial buildings. The applications for latches are as diverse as the imaginations of the designers and manufacturers who make assemblies that require temporary securing of covers, lids, and parts to other parts of in assemblies.

In manufacturing environments such as production lines, there are lids and covers to equipment that require continual opening and closing and securing the lids and covers while an operation is performed within the equipment. Latches that secure these lids and covers are not commonly visible in everyday life. There application in a manufacturing environment require that they undergo many more latch/unlatch cycles that would typically be experienced in an everyday consumer application.

SUMMARY OF THE INVENTION

Various embodiments of the present invention are described herein. An over-center latch assembly has a base for attaching the over-center latch assembly to a first part of a unit. The first part of the unit is moveable to a second part of the unit. A handle is rotatably coupled to the base by a hinge. A pivot is coupled to the handle such that the pivot traverses about the hinge. The pivot is configured to receive a hasp. A stop surface is coupled to the base whereby rotation of the handle about the hinge is limited by the stop surface. A hinge bearing is coupled to the hinge. The hinge bearing enables an increased quantity of latch/unlatch cycles of the over-center latch assembly before failure of the over-center latch assembly.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

Reference will now be made in detail to the alternative embodiment(s) of the present invention. While the invention will be described in conjunction with the alternative embodiment(s), it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of embodiments of the present invention, numerous specific details are set forth in order to provide a thorough understanding of the present invention. However, it will be recognized by one of ordinary skill in the art that embodiments of the present invention may be practiced without these specific details. In other instances, well known methods, procedures, and components have not been described in detail as not to unnecessarily obscure aspects of the present invention.

The discussion will begin with a description and overview of the over-center latch assembly and its operation. The discussion will then focus on embodiments of the present invention by which the latch/unlatch cycles of the over-center latch assembly are increased and the life of the over-center latch assembly is extended.

OVERVIEW

Figure 1A:
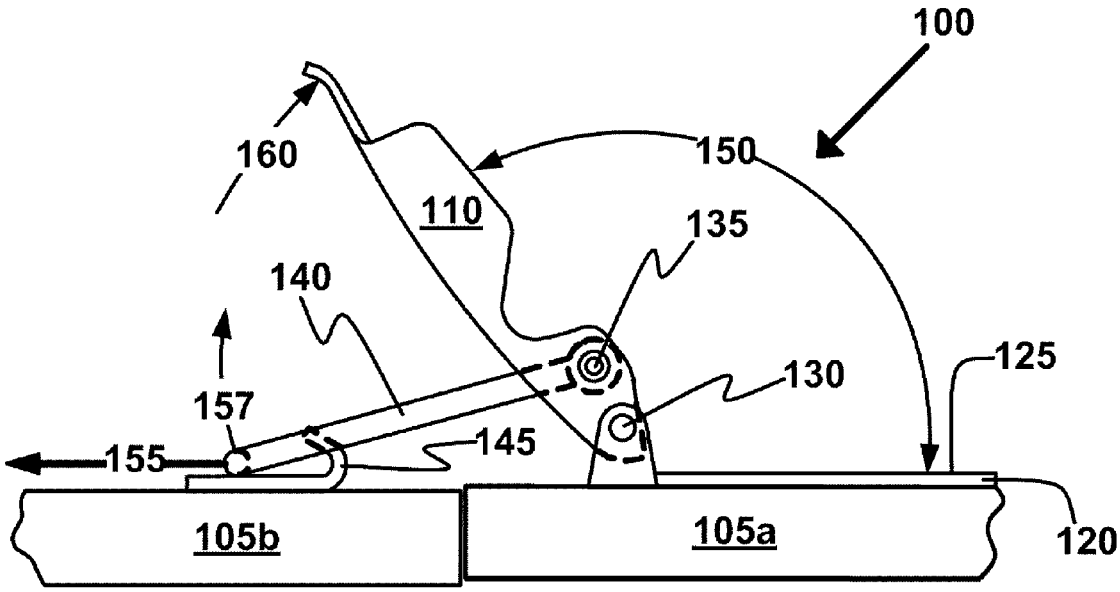
FIG. 1A is a side view of an over-center latch assembly operable to embodiments of the present invention.
Figure 1B:
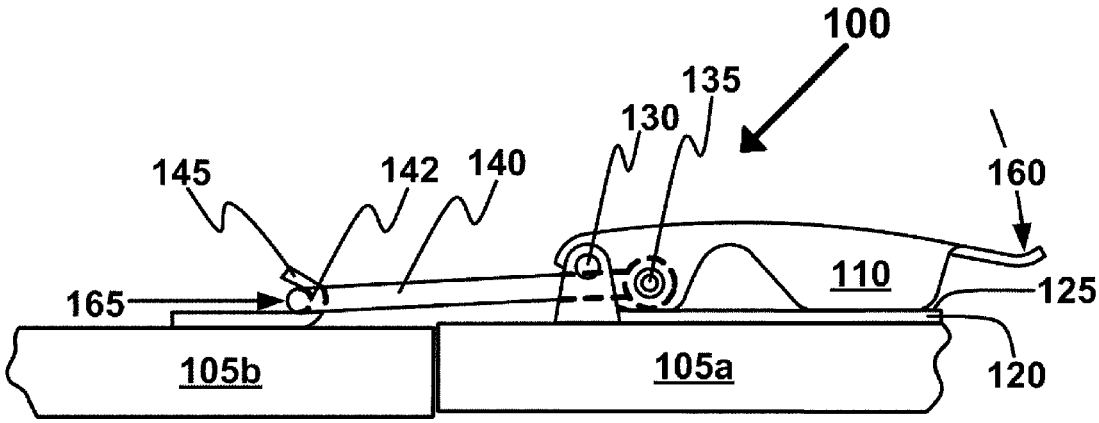
FIG. 1B is a side view of an over-center latch assembly operable to embodiments of the present invention.

With reference to FIG. 1A, a side view of over-center latch assembly 100 operable to embodiments of the present invention is presented. FIG. 1A presents over-center latch assembly 100 in an unlatched configuration. With reference to FIG. 1B, a side view of over-center latch assembly 100 operable to embodiments of the present invention is presented. FIG. 1B presents over-center latch assembly 100 in a latched configuration.

As presented in FIG. 1A and FIG. 1B over-center latch assembly 100 comprises base 120 for attaching over-center latch assembly 100 to first part 105*a* of a unit to be coupled to second part 105*b* of the unit. First part 105*a* is moveable with respect to second part 105*b*. Examples of a unit comprising a first part 105*a* and a second part 105*b* are: first part 105*a*, such as a truck engine compartment hood and a second part 105*b*, such as an engine compartment; first part 105*a*, such as a service panel door and a second part 105*b*, such as a service panel box; and first part 105*a*, such as a lid and a second part 105*b*, such as a tool box.

Over-center latch assembly 100 comprises handle 110 that is rotatably coupled to base 120 by hinge 130. Pivot 135 is coupled to handle 110 and is configured to receive hasp 140. Pivot 135 traverses about hinge 130 in an arc of rotation 150 that extends from a fully unlatched configuration presented in FIG. 1A, to a fully latched configuration presented in FIG. 1B. Base 120 comprises stop surface 125 whereby arc of rotation 150 is limited to a fully latched configuration.

Hasp 140 is configured to couple with hook 145. Typically a portion of hook 145 is configured to resemble the letter "J". Hasp 140 has a section that couples with the J-shape of hook 145. Hook 145 is either fabricated in unison with second part 105*b* or is fabricated as a separate component, which is coupled to second part 105*b*. Hasp 140 is configured in various shapes depending upon the design of hook 145. For example, hasp 140 is configured as a flattened oval, such as that presented in FIG. 2, and a T-shape to couple with a slot formed in hook 145, and a triangular shape. The configuration and design of the combination of hasp 140 and hook 145 are varied and depend upon the imagination of the over-center latch assembly designer and the application of the over-center latch assembly, for which it is being designed.

With continued reference to FIG. 1A, hasp 140 is moved in direction 155 with over-center latch assembly 100 in an unlatched configuration. Movement of hasp 140 in direction 155 is the result of handle 110 being rotated to its maximum arc of rotation 150. Movement of hasp 140 in direction 155 and direction 157 allows hasp 140 to decouple from hook 145. Decoupling of hook 145 and hasp 140 allows first part 105*a* to be moved with respect to second part 105*b*. The rotation of handle 110 to the near maximum arc of rotation 150 presents the unlatched configuration of over-center latch assembly 100.

With continued reference to FIG. 1A and FIG. 1B, force 160 is applied to handle 110 and approaches the near minimum of arc of rotation 150. The rotation of handle 110 towards its minimum arc of rotation 150 produces resultant force 165 being applied to interface 142 of hasp 140 and hook 145. Through the leverage and linkage established with handle 110, hinge 130 and pivot 135, resultant force 165 increases to its maximum at the interface 142 as interface 142, hinge 130, and pivot 130 become aligned. The continued application of force 160, decreases arc of rotation 150 to its minimum until handle 110 is stopped by stop surface 125. One of ordinary skill in the art appreciates that once pivot 135 proceeds beyond alignment with interface 142 and hinge 130, the reaction to resultant force 165 urges handle 110 to contact stop surface 125 and maintain resultant force at interface 142 and couples first part 105*a* with second part 105*b*.

It is appreciated that the latching of over-center latch assembly 100 to couple first part 105*a* with second part 105*b* can produce substantial coupling forces between first part 105*a* and second part 105*b*. These forces are typically equivalent to resultant force 165. It is obvious to one of ordinary skill in the art that the leverage and linkage in over-center latch assembly 100 cause resultant force 165 to also act on interface 142, hinge 130, and pivot 135. Resultant force 165 acting on hinge 130 and pivot 135 can be troublesome since hinge 130 and pivot 135 carry resultant force 165 while rotating through that portion of arc of rotation 150 in which contact exists between hasp 140 and hook 145.

Tests have shown that in one application, over-center latch assembly 100 fails after about 34,000 latch/unlatch cycles. Hinge 130 breaks 70% of the time and pivot 135 breaks 20% of the time. The other 10% of the failures is due to resultant force 165 breaking base 120. In some applications, such as securing and un-securing a cover to a test stand for testing a hard disk drive (HDD), 34,000 latch/unlatch cycles is too few cycles. A typical HDD manufacturing line having 16 to 20 HDD testers will need to replace approximately one over-center latch assembly per day. A broken over-center latch assembly on an HDD tester takes the HDD tester out of service, requiring maintenance and impacting HDD production.

Physical Description

Figure 2:
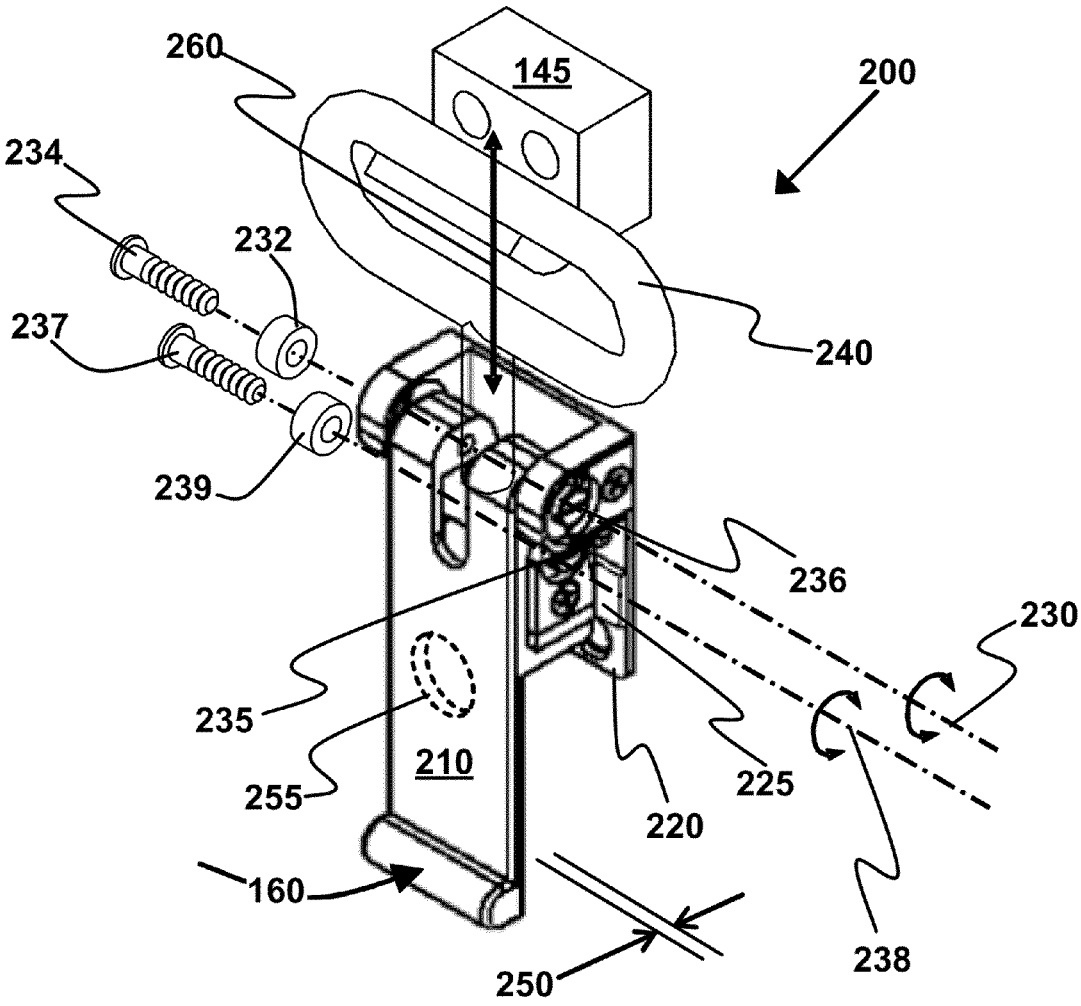
FIG. 2 is an isometric view of an over-center latch assembly in accordance with one embodiment of the present invention.

With reference to FIG. 2, an isometric view of over-center latch assembly 200 is presented in accordance with one embodiment of the present invention. Over-center latch assembly 200 comprises handle 210 that is rotatably coupled to base 220 by hinge 230. Pivot 238 is coupled to handle 210 and is configured to receive hasp 240. Pivot 238 traverses about hinge 230 during the rotation of handle 210 and operation of over-center latch assembly 200. Base 220 comprises stop surface 225 upon which handle 210 is stopped in the fully latched configuration of over-center latch assembly 200.

Hinge 230 is defined as any rotating device that enables handle 210 to traverse about a line which is indicated as hinge 230 in FIG. 2. Pivot 238 is defined as any rotational device that enables hasp 240 to traverse about a line which is indicated as pivot 238 in FIG. 2.

In accordance with an embodiment of the present invention, hinge 230 comprises at least one hinge bearing 232 and hinge pin (234, 236). Hinge bearing 232 and hinge pin 234 are presented in isometric blow-apart view in FIG. 2. Hinge bearing 232 enables an increased quantity of latch/unlatch cycles of over-center latch assembly 200 before over-center latch assembly 200 fails. Hinge bearing 232 is chosen from the group of bearings consisting of: a ball bearing, a thrust bearing, a roller bearing, a bronze bushing, and a plastic bushing.

In accordance with an embodiment of the present invention, pivot 238 comprises at least one pivot bearing 239 and at least one pivot pin (235, 237). Pivot bearing 239 and pivot pin 237 are presented in isometric blow-apart view in FIG. 2. Pivot bearing 239 enables an increased quantity of latch/unlatch cycles of over-center latch assembly 200 before over-center latch assembly 200 fails. Pivot bearing 239 is chosen from the group of bearings consisting of: a ball bearing, a thrust bearing, a roller bearing, a bronze bushing, and a plastic bushing. In accordance with another embodiment of the present invention, pivot 238 comprises pivot pin 235 having a right-handed thread, and pivot pin 237 having a left-handed thread.

In accordance with another embodiment of the present invention, stop surface 225 coupled to base 220 further comprises a shock absorbing material.

In accordance with another embodiment of the present invention, over-center latch assembly further comprises hasp 240 configured to couple with hook 145 coupled to a second part of a unit to which over-center latch assembly 200 is coupled to a first part of the unit. In accordance with another embodiment of the present invention, hasp 240 is configured to be adjusted in direction 260. Adjustment devices for hasp 240 are well known to one of ordinary skill in the art. Examples of adjustment methods include but are not limited to: internal screw threads on pivot 238 and matching screw threads on hasp 240; and a threaded coupling between pivot 238 and hasp 240.

Operation

With continued reference to FIG. 2, over-center latch assembly 200 is operational to latching by applying force 160 to handle 210. It has been discovered that as over-center latch assembly 200 approaches a latched configuration, handle 210 snaps against stop surface 225 resulting in noise that in some applications is unacceptable. One example of an application in which noise is unacceptable is a tester such as an acoustic tester for a hard disk drive. Excessive noise from extraneous sources, such as the snap from a noisy over-center latch can affect the results of an acoustic tester in which the noise level of a hard disk drive is being tested. Another example of an application in which noise is unacceptable is hospital equipment such as an incubator in a neonatal ward. Excessive noise from extraneous sources, such as the snap from a noisy over-center latch can be disturbing and stressful for a newborn baby.

With continued reference to FIG. 2, experimentation has shown that the momentum at which handle 210 stops against stop surface 225, affects the amplitude of the noise produced by the snapping of handle 210 against stop surface 225. In accordance with an embodiment of the present invention, the inertia of handle 210 is reduced by minimizing thickness 250 of handle 210 and thus reducing the momentum of handle 210 stopping against stop surface 225. Thickness 250 is limited by the minimum thickness required to provide sufficient strength to avoid yielding under force 160. In accordance with another embodiment of the present invention the momentum of handle 210 stopping against stop surface 225 is reduced by fabricating handle 210 comprising hole 255. Hole 255 removes material from handle 210 which reduces the inertia of handle 210, thereby reducing the momentum of handle 210 stopping against stop surface 225.

With continued reference to FIG. 2, over-center latch assembly 200 has stop surface 225 which comprises a shock absorbing material. Through experimentation, a suitable shock absorbing material has been discovered to be polyurethane. Although other shock absorbing materials can be used, polyurethane was chosen because it is inexpensive, readily available, and can be easily coupled with base 220. Stop surface 225 comprising shock absorbing material further reduces the noise produced from handle 210 snapping against stop surface 225.

In accordance with an embodiment of the present invention, pivot 238 comprises at least one pivot bearing 239 and at least one pivot pin (235, 237). Pivot bearing 239 and pivot pin 237 are presented in isometric blow-apart view in FIG. 2. In accordance with another embodiment of the present invention, pivot 238 comprises pivot pin 235 having a right-handed thread, and pivot pin 237 having a left-handed thread.

Experimentation has demonstrated that as force 160 is applied to handle 210, a reaction force acting at pivot bearing 239 results in a torque applied to pivot pin (235, 237). With respect to pivot pin 235, the torque acts in a clockwise direction, causing the right-handed threads of pivot pin 235 to tighten pivot pin 235 into handle 210. With respect to pivot pin 237, the torque acts in a counterclockwise direction. Pivot pin 237 requires a left-handed thread to prevent the torque from loosening pivot pin 237 from handle 210.

Figure 3:
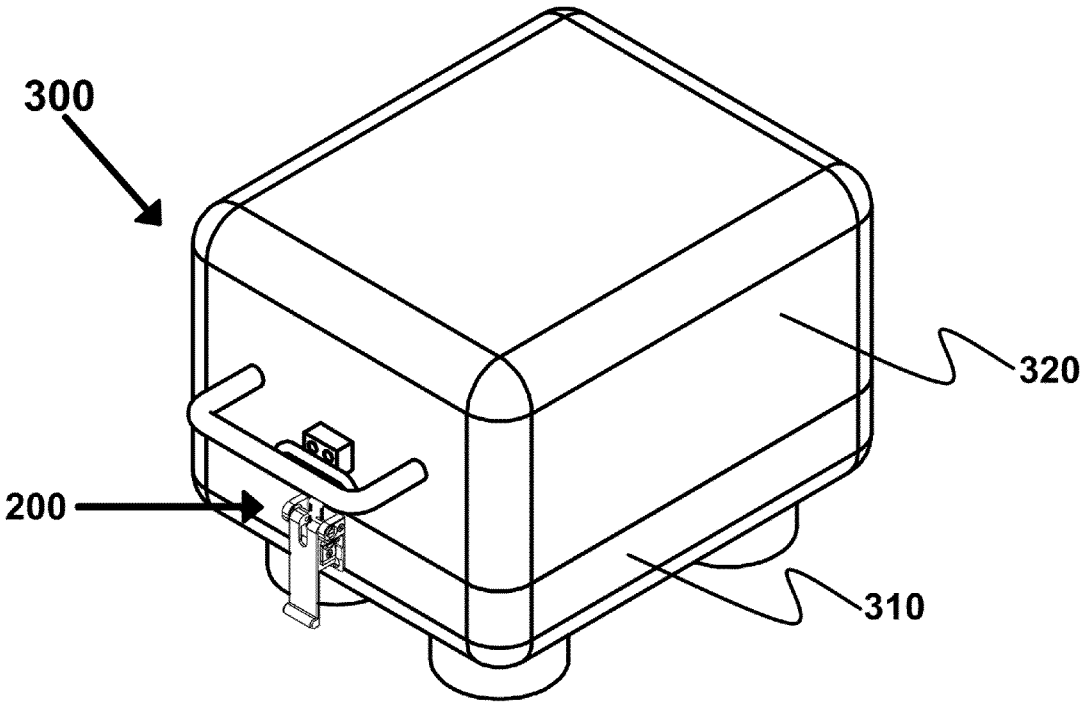
FIG. 3 is an isometric view of an enclosure in accordance with one embodiment of the present invention.

With reference to FIG. 3, an isometric view of enclosure 300 is presented in accordance with one embodiment of the present invention. Enclosure 300 comprises first part 310 moveably coupled with second part 320, wherein first part 310 is alternatingly secured and unsecured to second part 320 with over-center latch assembly 200. Over-center latch assembly 200 comprises handle 210 that is rotatably coupled to base 220 by hinge 230. Pivot 238 is coupled to handle 210 and is configured to receive hasp 240. Pivot 238 traverses about hinge 230 during the rotation of handle 210 and operation of over-center latch assembly 200. Base 220 comprises stop surface 225 upon which handle 210 is stopped in the fully latched configuration of over-center latch assembly 200.

In accordance with an embodiment of the present invention, over-center latch assembly 200 coupled with enclosure 300 comprises hinge 230, which comprises at least one hinge bearing 232 and hinge pin (234, 236). Hinge bearing 232 is chosen from the group of bearings consisting of: a ball bearing, a thrust bearing, a roller bearing, a bronze bushing, and a plastic bushing.

In accordance with an embodiment of the present invention, over-center latch assembly 200 coupled with enclosure 300, comprising stop surface 225 coupled to base 220, further comprises a shock absorbing material.

In accordance with another embodiment of the present invention, over-center latch assembly coupled with enclosure 300 further comprises hasp 240 configured to couple with hook 145 coupled to a second part of a unit to which over-center latch assembly 200 is coupled to a first part of the unit. In accordance with another embodiment of the present invention, hasp 240 is configured to be adjusted in direction 260. Adjustment devices for hasp 240 are well known to one of ordinary skill in the art. Examples of adjustment methods include but are not limited to: internal screw threads on pivot 238 and matching screw threads on hasp 240; and a threaded coupling between pivot 238 and hasp 240.

In accordance with another embodiment of the present invention, over-center latch assembly coupled with enclosure 300 comprising pivot 238 comprises at least one pivot bearing 239 and at least one pivot pin (235, 237). Pivot bearing 239 and pivot pin 237 are presented in isometric blow-apart view in FIG. 2. Pivot bearing 239 enables an increased quantity of latch/unlatch cycles of over-center latch assembly 200 before over-center latch assembly 200 fails. Pivot bearing 239 is chosen from the group of bearings consisting of: a ball bearing, a thrust bearing, a roller bearing, a bronze bushing, and a plastic bushing. In accordance with another embodiment of the present invention, pivot 238 comprises pivot pin 235 having a right-handed thread, and pivot pin 237 having a left-handed thread.

Figure 4:
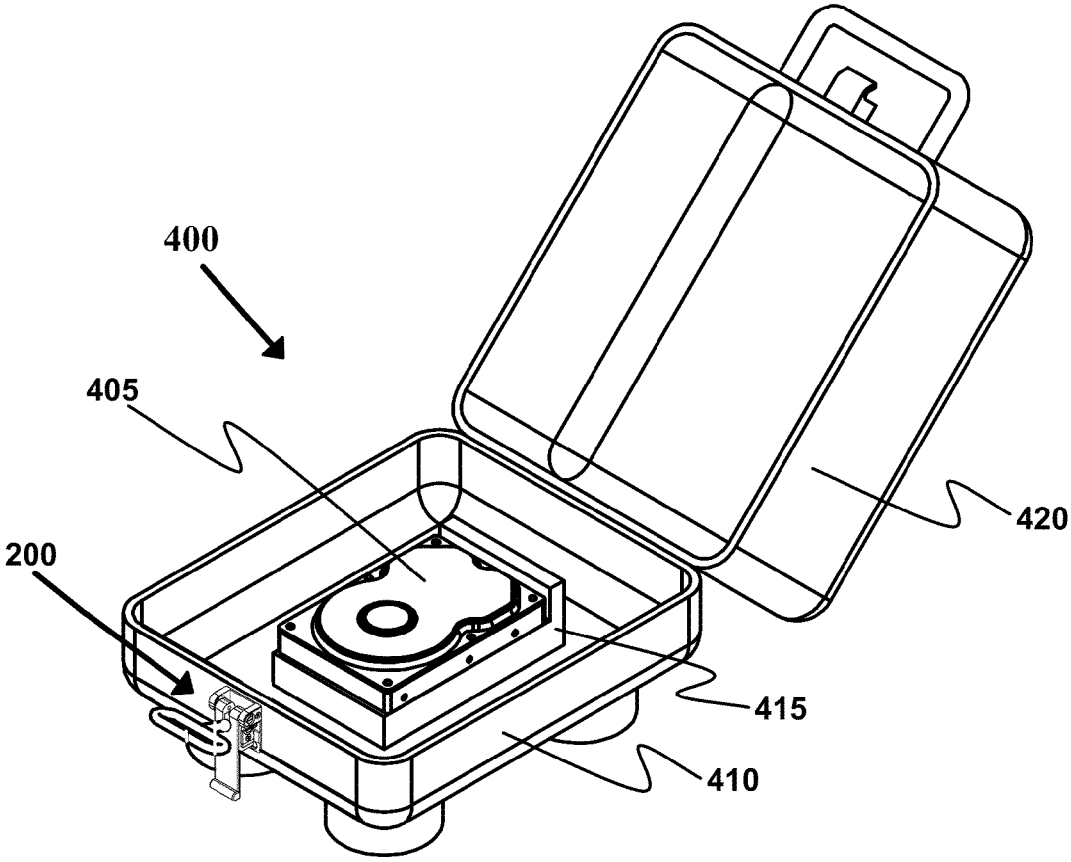
FIG. 4 is an isometric view of a hard disk drive tester in accordance with one embodiment of the present invention.

With reference to FIG. 4, an isometric view of hard disk drive tester 400 is presented in accordance with one embodiment of the present invention. Hard disk drive tester 400 comprises test stand 410 moveably coupled with cover 420, wherein test stand 410 is alternatingly secured and unsecured cover 420 with over-center latch assembly 200. Over-center latch assembly 200 comprises handle 210 that is rotatably coupled to base 220 by hinge 230. Pivot 238 is coupled to handle 210 and is configured to receive hasp 240. Pivot 238 traverses about hinge 230 during the rotation of handle 210 and operation of over-center latch assembly 200. Base 220 comprises stop surface 225 upon which handle 210 is stopped in the fully latched configuration of over-center latch assembly 200.

Hard disk drive tester 400 is configured to receive HDD 405. HDD coupler 415 is configured to couple HDD 405 with hard disk drive tester 400 depending upon the specific test that hard disk drive tester 400 is intended to perform. The following examples of hard disk drive tester 400 and an appropriately designed HDD coupler 415 are provided for the sake of brevity and clarity and are not intended to be an all inclusive listing of HDD test. HDD tests are well known and obvious to one of ordinary skill in the art. Examples of HDD tests and hard disk drive tester 400 which are in accordance with embodiments of the present invention are: acoustic test wherein coupler 415 is configured to provide power to HDD 405 and sense acoustic emissions from HDD 405; SAT wherein coupler 415 is configured to provide power to HDD 405 and receive data read from HDD 405; and magnetic test wherein coupler 415 is configured to provide power to HDD 405 and receive data read from HDD 405.

In accordance with an embodiment of the present invention, over-center latch assembly 200 coupled with hard disk drive tester 400 comprises hinge 230, which comprises at least one hinge bearing 232 and hinge pin (234, 236). Hinge bearing 232 is chosen from the group of bearings consisting of: a ball bearing, a thrust bearing, a roller bearing, a bronze bushing, and a plastic bushing.

In accordance with an embodiment of the present invention, over-center latch assembly 200 coupled with hard disk drive tester 400, comprising stop surface 225 coupled to base 220, further comprises a shock absorbing material.

In accordance with another embodiment of the present invention, over-center latch assembly coupled with hard disk drive tester 400 further comprises hasp 240 configured to couple with hook 145 coupled to a second part of a unit to which over-center latch assembly 200 is coupled to a first part of the unit. In accordance with another embodiment of the present invention, hasp 240 is configured to be adjusted in direction 260. Adjustment devices for hasp 240 are well known to one of ordinary skill in the art. Examples of adjustment methods include but are not limited to: internal screw threads on pivot 238 and matching screw threads on hasp 240; and a threaded coupling between pivot 238 and hasp 240.

In accordance with another embodiment of the present invention, over-center latch assembly coupled with hard disk drive tester 400 comprising pivot 238 comprises at least one pivot bearing 239 and at least one pivot pin (235, 237). Pivot bearing 239 and pivot pin 237 are presented in isometric blow-apart view in FIG. 2. Pivot bearing 239 enables an increased quantity of latch/unlatch cycles of over-center latch assembly 200 before over-center latch assembly 200 fails. Pivot bearing 239 is chosen from the group of bearings consisting of: a ball bearing, a thrust bearing, a roller bearing, a bronze bushing, and a plastic bushing. In accordance with another embodiment of the present invention, pivot 238 comprises pivot pin 235 having a right-handed thread, and pivot pin 237 having a left-handed thread.

The present invention, in the various presented embodiments provides an increased life expectancy for an over-center latch assembly and increases the quantity of latch/unlatch cycles of the over-center latch assembly before failure of the over-center latch assembly. Experimentation has demonstrated that the various presented embodiments increase the life expectancy of an over-center latch assembly from 34,000 latch/unlatch cycles to 234,000 latch/unlatch cycles. Embodiments of the present invention wherein an increased quantity of secure/unsecure cycles of a cover to a test stand of a hard disk drive tester increases the availability of HDD tester to the manufacturing line by 580%. Maintenance cost and the impact of out-of-service HDD testers is reduced.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments described herein were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. An over-center latch assembly comprising:

a base for attaching said over-center latch assembly to a first part of a unit, wherein said first part of said unit is moveable with respect to a second part of said unit;

a handle rotatably coupled to said base by a hinge;

a pivot coupled to said handle such that said pivot is configured to traverse about said hinge, wherein said pivot comprises a first pivot pin comprising a right-handed thread and an opposing second pivot pin comprising a left-handed thread, the threads in said first and second pivot pin preventing loosening from the handle when torque is applied to the handle, and wherein said pivot is configured to receive a hasp, wherein said hasp is configured for coupling said hasp with said second part of said unit;

a stop surface coupled to said base whereby rotation of said handle about said hinge is limited by said stop surface; and a hinge bearing coupled to said hinge, whereby said hinge bearing enables an increased quantity of latch/unlatch cycles of said over-center latch assembly before failure of said over-center latch assembly.

2. The over-center latch assembly of claim 1 further comprising an adjustable hasp coupled to said pivot wherein said hasp is configured to couple with said second part of said unit.

3. The over-center latch assembly of claim 1, wherein said pivot comprises a pivot bearing.

4. The over-center latch assembly of claim 1, wherein said stop surface comprises a shock absorbing material.

5. The over-center latch assembly of claim 1, wherein said hinge bearing coupled to said hinge is chosen from the group of bearings consisting of: a ball bearing, a thrust bearing, a roller bearing, a bronze bushing, and a plastic bushing.

6. The over-center latch assembly of claim 3, wherein said pivot bearing is chosen from the group of bearings consisting of: a ball bearing, a thrust bearing, a roller bearing, a bronze bushing, and a plastic bushing.

7. An enclosure, which comprises a first part moveably coupled with a second part, wherein said first part is alternatingly secured and unsecured to said second part with an over-center latch assembly, said over-center latch assembly comprising:

a base for attaching said over-center latch assembly to said first part of said enclosure, wherein said first part of said enclosure is moveable with respect to a second part of said enclosure;

a handle rotatably coupled to said base by a hinge;

a pivot coupled to said handle such that said pivot is configured to traverse about said hinge, wherein said pivot comprises a first pivot pin comprising a right-handed thread and an opposing second pivot pin comprising a left-handed thread, the threads in said first and second pivot pin preventing loosening from the handle when torque is applied to the handle, and wherein said pivot is configured to receive a hasp, wherein said hasp is configured for coupling said hasp with said second part of said enclosure;

a stop surface coupled to said base whereby rotation of said handle about said hinge is limited by said stop surface; and a hinge bearing coupled to said hinge, whereby said hinge bearing enables an increased quantity of secure/unsecure cycles of said first part of said enclosure to said second part of said enclosure before failure of said over-center latch assembly.

8. The enclosure of claim 7 further comprising an adjustable hasp coupled to said pivot wherein said hasp is configured to couple with said second part of said enclosure.

9. The enclosure of claim 7, wherein said pivot comprises a pivot bearing.

10. The enclosure of claim 7, wherein said stop surface comprises a shock absorbing material.

11. The enclosure of claim 7, wherein said hinge bearing coupled to said hinge is chosen from the group of bearings consisting of: a ball bearing, a thrust bearing, a roller bearing, a bronze bushing, and a plastic bushing.

12. The enclosure of claim 9, wherein said pivot bearing is chosen from the group of bearings consisting of: a ball bearing, a thrust bearing, a roller bearing, a bronze bushing, and a plastic bushing.

13. A hard disk drive tester, which comprises a cover moveably coupled with a test stand, wherein said cover is alternatingly secured and unsecured to said test stand with an over-center latch assembly, said over-center latch assembly comprising:

a base for attaching said over-center latch assembly to said test stand, wherein said cover is moveable with respect to said test stand;

a handle rotatably coupled to said base by a hinge;

a pivot coupled to said handle such that said pivot is configured to traverse about said hinge, wherein said pivot comprises a first pivot pin comprising a right-handed thread and an opposing second pivot pin comprising a left-handed thread, the threads in said first and second pivot pin preventing loosening from the handle when torque is applied to the handle, and wherein said pivot is configured to receive a hasp, wherein said hasp is configured for coupling said hasp with said test stand;

a stop surface coupled to said base whereby rotation of said handle about said hinge is limited by said stop surface; and a hinge bearing coupled to said hinge, whereby said hinge bearing enables an increased quantity of secure/unsecure cycles of said cover of said hard disk drive tester to said test stand of said hard disk drive tester before failure of said over-center latch assembly.

14. The hard disk drive tester of claim 13 further comprising an adjustable hasp coupled to said pivot wherein said hasp is configured to couple with said cover of said hard disk drive tester.

15. The hard disk drive tester of claim 13, wherein said pivot comprises a pivot bearing.

16. The hard disk drive tester of claim 13, wherein said stop surface comprises a shock absorbing material.

17. The hard disk drive tester of claim 13, wherein said hinge bearing coupled to said hinge is chosen from the group of bearings consisting of: a ball bearing, a thrust bearing, a roller bearing, a bronze bushing, and a plastic bushing.

18. The hard disk drive tester of claim 13, wherein said pivot bearing is chosen from the group of bearings consisting of: a ball bearing, a thrust bearing, a roller bearing, a bronze bushing, and a plastic bushing.

* * * * *

UNITED STATES PATENT AND TRADEMARK OFFICE

CERTIFICATE OF CORRECTION

PATENT NO. : 8,240,724 B2
APPLICATION NO. : 12/103623
DATED : August 14, 2012
INVENTOR(S) : Supan Boonmatun It is certified that error appears in the above-identified patent and that said Letters Patent is hereby corrected as shown below:

Column 10, Line 15, Claim 18: Delete, "claim 13"
Insert, --claim 15--

Signed and Sealed this
Twenty-sixth Day of February, 2013

Teresa Stanek Rea
*Acting Director of the United States Patent and Trademark Office*